US010323846B2

(12) United States Patent
Sweet et al.

(10) Patent No.: US 10,323,846 B2
(45) Date of Patent: Jun. 18, 2019

(54) SAFETY AND CONVENIENCE SYSTEM FOR A GAS GRILL

(71) Applicants: William Lawrence Sweet, Atlanta, GA (US); Scott Michael Schroer, Dunwoody, GA (US); Alexander Donald Roe, San Francisco, CA (US)

(72) Inventors: William Lawrence Sweet, Atlanta, GA (US); Scott Michael Schroer, Dunwoody, GA (US); Alexander Donald Roe, San Francisco, CA (US)

( * ) Notice: Subject to any disclaimer, the term of this patent is extended or adjusted under 35 U.S.C. 154(b) by 546 days.

(21) Appl. No.: 15/017,410

(22) Filed: Feb. 5, 2016

(65) Prior Publication Data

US 2016/0230992 A1 Aug. 11, 2016

Related U.S. Application Data

(60) Provisional application No. 62/183,723, filed on Jun. 23, 2015, provisional application No. 62/112,226, filed on Feb. 5, 2015.

(51) Int. Cl.

| | |
|---|---|
| ***F23N 5/24*** | (2006.01) |
| ***F23N 1/00*** | (2006.01) |
| ***F23N 5/02*** | (2006.01) |

(52) U.S. Cl.

CPC ..... *F23N 5/242* (2013.01); *F23N 1/002* (2013.01); *F23N 5/022* (2013.01); *F23N 2023/38* (2013.01); *F23N 2031/20* (2013.01)

(58) Field of Classification Search

CPC .. F23N 2031/18; F23N 5/003; F23N 2031/20; G08B 21/182

See application file for complete search history.

(56) References Cited

U.S. PATENT DOCUMENTS

| | | | | | |
|---|---|---|---|---|---|
| 3,901,179 | A * | 8/1975 | Dunn | G08B 17/02 | 116/104 |
| 4,515,561 | A * | 5/1985 | Melgaard | D02J 13/001 | 126/21 A |
| 4,584,448 | A * | 4/1986 | Tanabe | H05B 6/6458 | 219/705 |
| 4,954,694 | A * | 9/1990 | Nagai | F24C 14/02 | 219/393 |
| 5,608,383 | A * | 3/1997 | Neil | G08B 21/182 | 340/588 |
| 5,807,098 | A * | 9/1998 | Deng | F23N 5/006 | 126/112 |

(Continued)

*Primary Examiner* — Jorge A Pereiro

(74) *Attorney, Agent, or Firm* — Troutman Sanders LLP; Ryan A. Schneider

(57) ABSTRACT

The present disclosure introduces a safety and convenience system for a gas grill. The disclosed system can have a grill assembly, a sensor assembly, and a system controller. The grill assembly can include a grill body, a grill lid, a grilling surface, one or more burners, a gas feed line, a grill adjustment valve, and an igniter. The sensor assembly may include gas sensors, temperature sensors, and these sensors can reside in a single or multiple sensor housings. The system controller can be connected to the sensors and receive a gas sensor value and a temperature sensor value. Based on the gas sensor value and the temperature sensor value, the system controller can be able to indicating a condition of the grill to a user, or control a feature of the grill for convenience or safety.

16 Claims, 5 Drawing Sheets

(56) References Cited

U.S. PATENT DOCUMENTS 6,000,931 A * 12/1999 Tanabe ..... G01M 3/2807 431/22
6,155,160 A * 12/2000 Hochbrueckner ..... G05D 23/1917 126/112
7,703,389 B2 * 4/2010 McLemore ..... A47J 37/1209 340/501
7,933,733 B2 * 4/2011 Ashrafzadeh ..... G01F 23/2928 340/686.1
9,107,536 B1 * 8/2015 Rasmussen ..... A47J 37/0713
9,674,323 B1 * 6/2017 Yu ..... H04M 1/0274
10,085,585 B2 * 10/2018 Siegel ..... A47J 27/62
2001/0042564 A1 * 11/2001 Abraham ..... F23D 14/26 137/65
2003/0096590 A1 * 5/2003 Satoh ..... G08B 21/02 455/404.1
2005/0229918 A1 * 10/2005 Shim ..... F23D 14/72 126/39 BA
2009/0004612 A1 * 1/2009 West ..... F23N 1/002 431/22
2009/0207029 A1 * 8/2009 Shah ..... G08B 17/10 340/577
2009/0302026 A1 * 12/2009 Shaw ..... F24C 7/08 219/489
2010/0012165 A1 * 1/2010 Bedard ..... A47J 37/0786 136/205
2010/0102959 A1 * 4/2010 Ashrafzadeh ..... G06Q 10/087 340/540
2011/0203131 A1 * 8/2011 Armstrong ..... D06F 58/28 34/572
2012/0293335 A1 * 11/2012 Struyk ..... G01P 13/002 340/632
2013/0206015 A1 * 8/2013 Jacoby ..... A47J 37/07 99/330
2013/0320003 A1 * 12/2013 Hwang ..... H05B 6/6435 219/720
2014/0098835 A1 * 4/2014 Herzog ..... G01K 11/265 374/117
2014/0110613 A1 * 4/2014 Pitchford ..... F16K 31/082 251/129.01
2014/0132763 A1 * 5/2014 Billau ..... H04N 7/162 348/143
2014/0132772 A1 * 5/2014 Billau ..... G08B 13/19682 348/159
2014/0133831 A1 * 5/2014 Billau ..... H04N 5/76 386/262
2014/0234496 A1 * 8/2014 Siegel ..... A47J 27/62 426/231
2014/0313048 A1 * 10/2014 Sabata ..... H04Q 9/00 340/870.01
2016/0003660 A1 * 1/2016 Martinez, Jr. ..... G01F 23/20 73/296
2016/0037966 A1 * 2/2016 Chin ..... A47J 37/0682 426/231
2017/0278371 A1 * 9/2017 Abe ..... G08B 17/00

* cited by examiner

SAFETY AND CONVENIENCE SYSTEM FOR A GAS GRILL

CROSS-REFERENCE TO RELATED APPLICATION AND PRIORITY CLAIM

This application claims the benefit, under 35 U.S.C. § 119(e), of U.S. Provisional Patent Application No. 62/112,226, filed 5 Feb. 2015, entitled "GAS MONITORING AND SENSOR APPARATUS AND METHODS OF MAKING AND USING THE SAME," and U.S. Provisional Patent Application No. 62/183,723, filed 23 Jun. 2015, entitled "INTERNET INTEGRATED GAS MONITORING AND SENSOR APPARATUS AND METHODS OF MAKING AND USING THE SAME," the entire contents and substance of both provisional applications are incorporated herein by reference in their entirety as if fully set forth below.

BACKGROUND

Field of the Invention

Embodiments of the present invention relate to a safety and convenience system for a gas grill and, more particularly, a system having gas and temperature sensors for determining whether the grill chamber is safe to light, as well as other operating parameters.

Description of the Related Art

Nearly half of U.S. households own a grill. Each year, these grills cause millions of dollars in damage, injuries, and even deaths. Many of these accidents are the result of an explosion due to an unsafe lighting event or a grill left unattended. Unsafe lighting events occur when the gas or starter fluid buildup in the grill exceeds a safe level, and then an ignition source is activated. When this occurs, flare ups, fireballs, and even explosions may result. Unattended grills can also cause plants, grill covers, or even homes to catch fire. Most of these accidents can be prevented.

Gas grills make up a large portion of the grill market, and the basic design has changed very little over the years. These grills use fuel stored in a tank, routed through fuel lines to a burner, and often include adjustment valves and an igniter to control the flow of gas and to provide the spark to ignite the fuel. Features such as electric ignition, multiple burners, ceramic infrared heating elements, and thermometers, each have their own benefits, but none address the safety of the grill.

Therefore, what is needed is a system that can be built into, or retrofitted onto a gas grill to provide a measure of safety to prevent unsafe lighting events and/or unattended grill fires. Furthermore, these additional safety measures can also add convenience features to a grill. It is to such a system that this disclosure is directed.

SUMMARY

Features of the present disclosure include safety features, as well as convenience features. The system can use sensors and actuators to provide automatic or remote shut off, monitoring, or starting of a gas grill. The system can also warn of unsafe conditions, and in some applications, can take active control steps to prevent an unsafe lighting event. A system according to this disclosure may also be able to automatically turn off a grill after a predetermined period of time, if the grill is knocked over, or if it has been left unattended for too long. The increases in both safety and convenience can result in fewer accidents, and an increased ability to grill safely and conveniently.

In some embodiments, a grilling system according to the present disclosure can include a grill assembly, a sensor assembly, and a system controller. The grill assembly can be made up of a grill body, a grill lid, a grilling surface, one or more burners, a gas feed line, a grill adjustment valve, and an igniter. The sensor assembly can include a gas sensor, a temperature sensor, and a sensor housing. In some embodiments, the system controller may be connected to the gas sensor and the temperature sensor and be capable of receiving a gas sensor value and a temperature sensor value. The system controller may be capable of indicating a condition of the grill to a user based on the gas sensor value and the temperature sensor value.

In some embodiments, an unsafe condition of the grilling system assembly can be identified when the temperature sensor value is less than about 150 degrees Fahrenheit, and the gas sensor value is greater than about 500 ppm; while a safe condition of the grilling system can be identified when the temperature sensor value is greater than about 150 degrees Fahrenheit, and/or the gas sensor value is less than about 500 ppm. The system may further include one or more indicator lights with which to indicate a safe condition or unsafe condition to the user. The grilling system can have an audible alarm so that the system controller can indicates the unsafe condition to the user by activating the alarm.

In some embodiments, the sensor housing is removably attached to one or more of the grill body, the grill lid, and the grilling surface. This attachment may be accomplished by the sensor housing being magnetic. A shutoff valve can be located in the gas feed line so that the system controller can actuate the shutoff valve in response to the unsafe condition being identified. In some embodiments, this may be in concert with or alternative to the system controller disabling the igniter in response to the unsafe condition being identified.

In order to allow the system controller to notify and accept commands from a user, the system can be provided with a wireless radio, such as a Bluetooth or Wi-Fi transceiver. This radio can enable a user to receive notifications on their mobile device or other portable notification device. In some embodiments, the grilling system can be configures such that the wireless radio can receive a user command inputted via a mobile application on a mobile device, such as a request to activate the igniter and/or actuate the shutoff valve. If the system is provided with an adjustment valve actuator, the system controller may be able to engage the adjustment valve actuator to actuate the grill adjustment valve. This can have the effect of adjusting the temperature of the grill assembly.

Some embodiments of the disclosed grilling system can use a tank weight sensor positioned underneath the gas tank to determine the amount of gas remaining in the gas tank. The system controller can then indicate the amount of gas remaining to a user via the mobile application. The system controller can also be able to actuate the shutoff valve after an amount of time determined by the user command. In some embodiments, the user can use the mobile app to set a timer or run a heating cycle, such as a higher temperature for a predetermined cleaning time, and then actuates the shut off valve.

Further features of systems in accordance with the present disclosure, and the advantages offered thereby, are explained in greater detail hereinafter with reference to specific embodiments illustrated in the accompanying drawings, wherein like elements are indicated by like reference designators.

DETAILED DESCRIPTION

Figure 1:
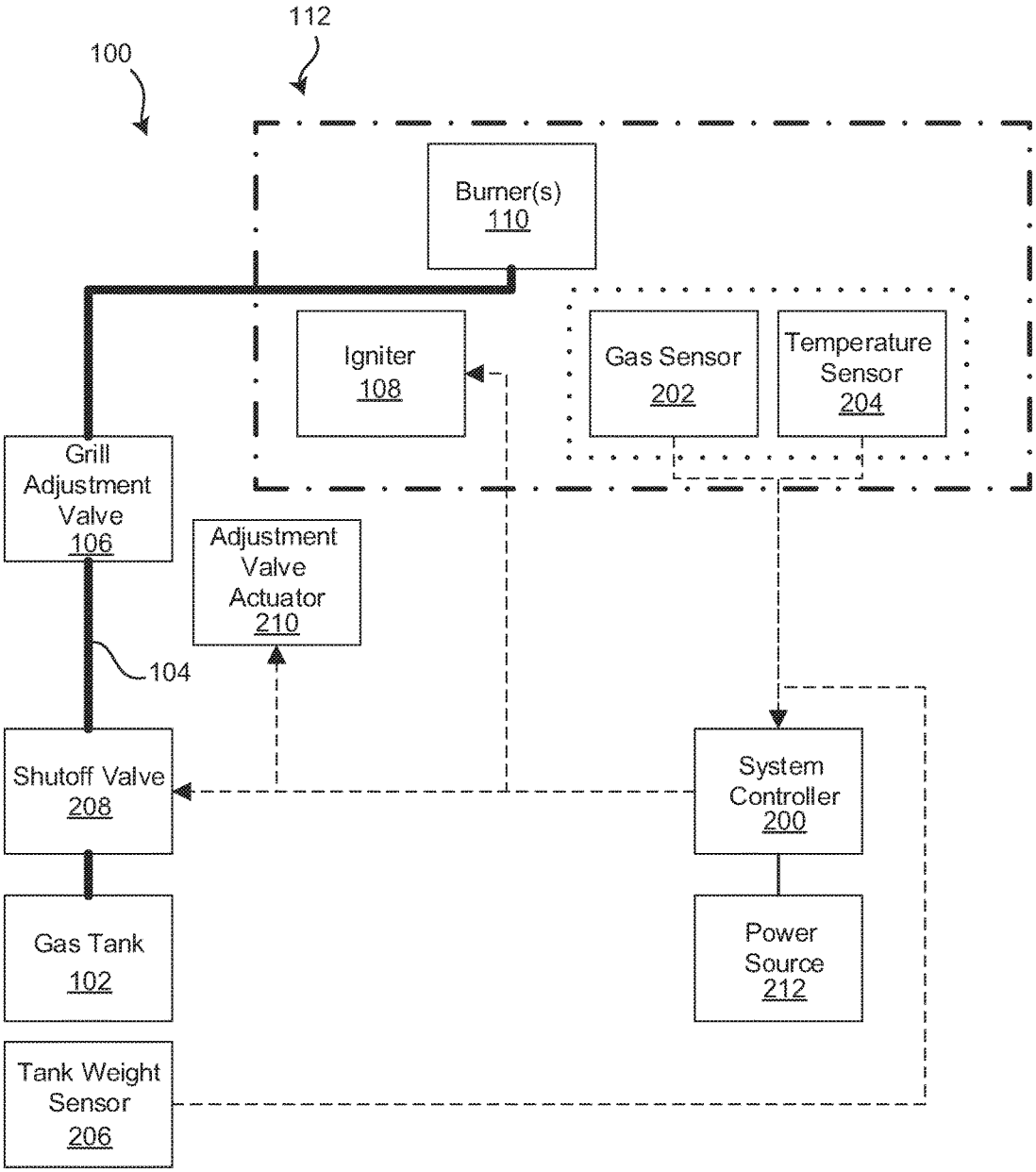
FIG. 1 is a schematic depiction of a grilling system according to an embodiment of the present disclosure.

To facilitate an understanding of the principles and features of the various embodiments of the invention, various illustrative embodiments are explained below. Although exemplary embodiments of the invention are explained in detail as being grilling systems that provide safety and/or convenience features, it is to be understood that other embodiments are contemplated, such as embodiments employing additional sensors, actuators, mobile application features, and the like. Accordingly, it is not intended that the invention be limited in its scope to the details of construction and arrangement of components set forth in the following description or examples. The disclosed systems are capable of other embodiments and of being practiced or carried out in various ways. Also, in describing the exemplary embodiments, specific terminology will be resorted to for the sake of clarity.

It must also be noted that, as used in the specification and the appended claims, the singular forms "a," "an" and "the" include plural references unless the context clearly dictates otherwise. For example, reference to a component is intended also to include composition of a plurality of components. References to a composition containing "a" constituent is intended to include other constituents in addition to the one named.

Also, in describing the exemplary embodiments, terminology will be resorted to for the sake of clarity. It is intended that each term contemplates its broadest meaning as understood by those skilled in the art and includes all technical equivalents which operate in a similar manner to accomplish a similar purpose.

Ranges may be expressed herein as from "about" or "approximately" or "substantially" one particular value and/or to "about" or "approximately" or "substantially" another particular value. When such a range is expressed, other exemplary embodiments include from the one particular value and/or to the other particular value.

By "comprising" or "containing" or "including" is meant that at least the named compound, element, particle, or method step is present in the composition or article or method, but does not exclude the presence of other compounds, materials, particles, method steps, even if the other such compounds, material, particles, method steps have the same function as what is named.

It is also to be understood that the mention of one or more method steps does not preclude the presence of additional method steps or intervening method steps between those steps expressly identified. Similarly, it is also to be understood that the mention of one or more components in a composition does not preclude the presence of additional or equivalent components other than or in addition to those expressly identified.

The materials described as making up the various elements of the invention are intended to be illustrative and not restrictive. Many suitable materials that would perform the same or a similar function as the materials described herein are intended to be embraced within the scope of the invention. Such other materials not described herein can include, but are not limited to, for example, materials that are developed after the time of the development of the invention.

To facilitate an understanding of the principles and features of this disclosure, various illustrative embodiments are explained below. In particular, various embodiments of this disclosure are described as a grilling system that provides safety and convenience features. Some embodiments of the invention, however, may be applicable to other contexts, and embodiments employing these applications are contemplated. For example and not limitation, some embodiments of the disclosure may be applicable to various types of cooking or heating systems, both outdoors and indoors.

FIG. 1 illustrates a schematic of an embodiment of a grilling system 100. Grilling system 100 includes conventional gas grill components such as gas tank 102, gas feed line 104, one or more grill adjustment valves 106, igniter 108, and one or more burners 110. Igniter 108, and burner 110 may be housed in grill body 112. The function of this combination of components is well known in the art. A user would open a valve on gas tank 102 to start the flow of gas through gas feed line 104. Then, by opening grill adjustment valve 106, gas begins to flow to burner 110 in grill body 112. By actuating igniter 108, a flame is lit on and around burner 110, and grill adjustment valve 106 may then be used to control the size and intensity of that flame.

Grilling system 100 may be provided with system controller 200. System controller 200 may be a basic processor of any suitable type known in the art capable of receiving sensory inputs, running logic operations, and outputting control signals in response to those sensory inputs. System controller 200 can be connector to one or more gas sensors 202 and/or one or more temperature sensors 204. Gas sensor 202 and temperature sensor 204 may be located inside grill body 112, in order to monitor the conditions therein. System controller may also be connected to a tank weight sensor 206 that is able to weigh gas tank 102, and determine the amount of gas in tank 102.

Gas sensor 202 may be of any suitable type known in the art, such as semiconductor gas detectors and infrared gas sensors. Sensors may be selected to be robust and heat resistant, due to the rigors of the grill application. Sensors requiring maintenance or frequent calibration may not be ideal, due to the long periods of time that may pass (for example, over the winter) between uses. Appropriate sensor selection may be important for the cost effectiveness and functionality of the system.

Sensors 202, 204, and 206 are able to provide system controller 200 with information necessary to determine the safety of the grill as well as the remaining gas in tank 102. By using this information, system controller 200 can be provided with actuators to adjust the functionality of grilling system 100. For example, shutoff valve 208 can be connected to system controller 200 to allow for the shutoff of the gas flow from tank 102 to burner 110. Adjustment valve actuator 210 can also be connected to controller 200 and provide the ability to adjust grill adjustment valve 106. By controlling actuator 210, the grilling system can adjust the flow of gas to burner 110, or to one of multiple burners 110 to control the temperature and temperature profile inside grill body 112. Igniter 108 may be connected to system controller 200 as well. This connection can allow system controller 200 to provide ignition to burner 110 as needed to light a flame and begin the grilling process.

System controller may be powered by power source 212. Power source 212 may be a battery, plugged into an electrical socket, a solar cell, a thermoelectric generator, any combination thereof, or other suitable power system. While batteries or plug-in power sources may be the more conventional power options, solar and thermoelectric power may be viable in this application. Many grills are stored outside, in or near direct sunlight. This provides the grill with an excellent source of sunlight to power the system. Similarly, because grills generate a great deal of heat, thermoelectric power, particularly if used to charge batteries, may also be viable. Thermoelectric cells use a temperature difference (i.e. the inside of the grill versus the outside) to generate electricity. The waste heat from the grilling process may be capable of providing sufficient power to enable the system controller and/or other components. Depending on the selection of power source and other components, power source 212 can also provide the power necessary for sensors 202, 204, and 206, actuators 208 and 210, and igniter 108 to function. Additionally or in lieu of such an arrangement, each component may be powered separately.

Figure 2:
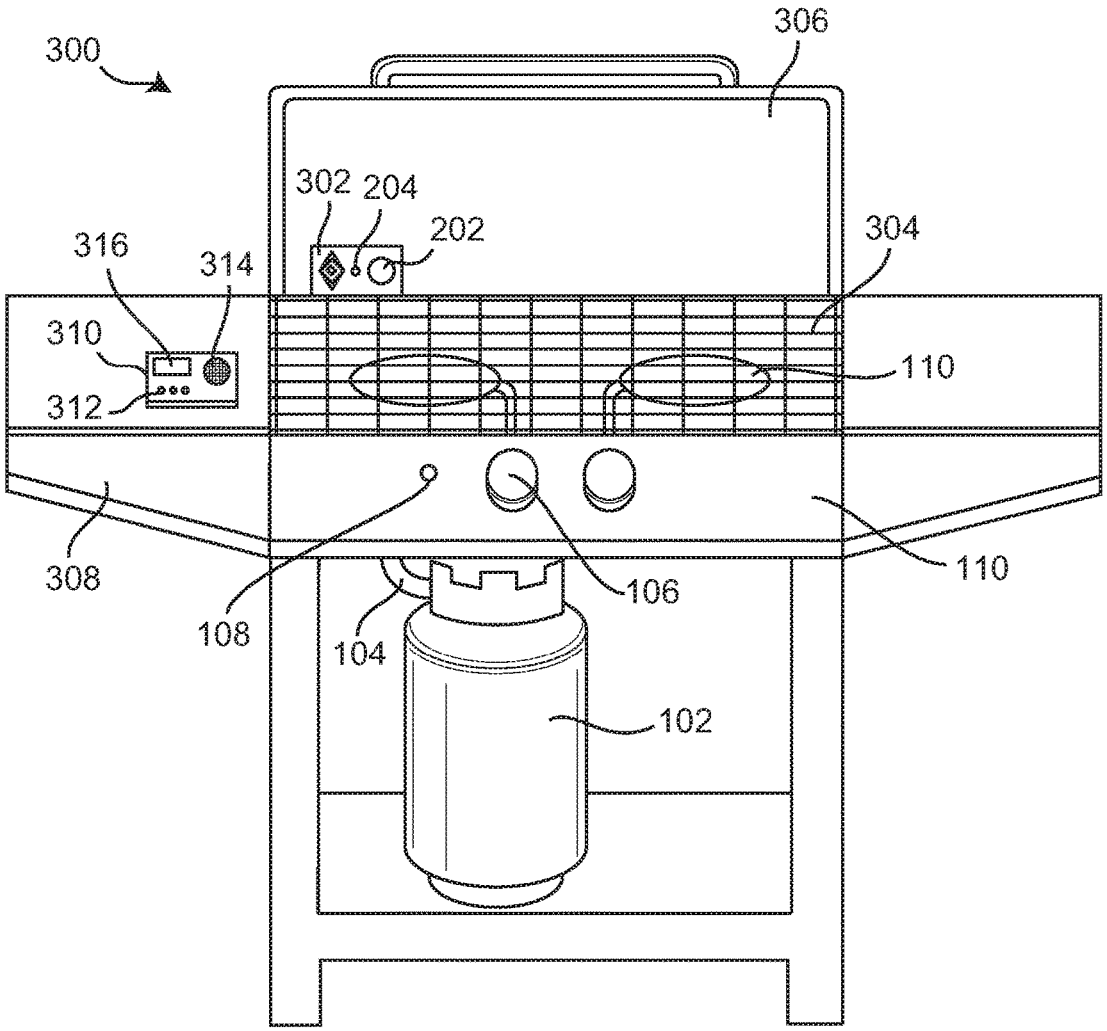
FIG. 2 is a front view of a grill assembly according to an embodiment of the present disclosure.

FIG. 2 illustrates where the many of the components described with respect to FIG. 1 are located on a conventional grill assembly 300. Grill body 110 can house sensor assembly 302, as well as gas tank 102, gas feed line 104, grill adjustment valves 106, igniter 108, burners 110, and grilling surface 304. Grill body 110 may include a hinged or removable grill lid 306. Sensor assembly 302 can be a single unit or individual sensor components that can include gas sensor 202 and temperature sensors 204. Shelf portion 308 of grill assembly 300 may house or support indicator assembly 310. Indicator assembly 310 may include indicator lights 312, alarm 314, and indicator screen 316. System controller 200 may be housed within indicator assembly 308, or elsewhere in or on grill assembly 300, depending on the specific application desired.

Figure 3:
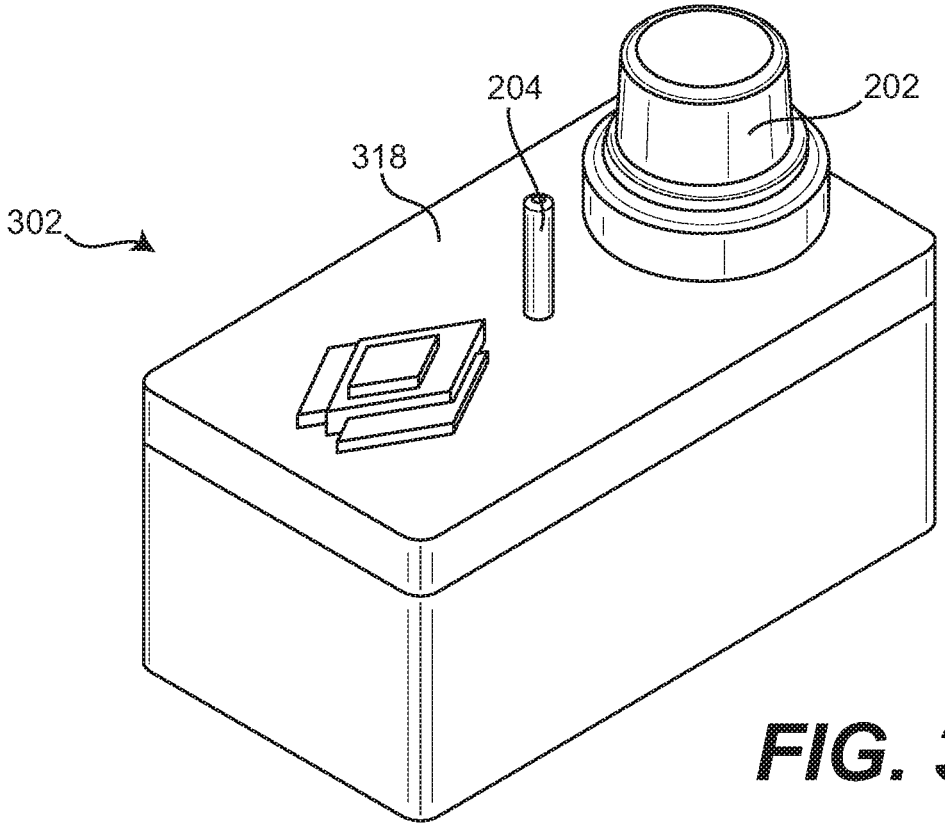
FIG. 3 is a top perspective view of a sensor assembly in accordance with an embodiment of the present disclosure.

FIG. 3 shows a closer view of an embodiment of sensor assembly 302. Sensor assembly 302 may be made up of sensor housing 318, gas sensor 202, and temperature sensor 204. In some embodiments according to the present disclosure, sensor housing 318 may be a heat resistant housing, and be provided with a means of attaching or otherwise securing itself inside grill body 110. Examples of such attachment mechanisms include hooks, a shelf system, or a magnetic attachment system. Because many gas grills are made of metal, a magnetic housing may allow for easy, reliable, and removable installation of sensor assembly 302.

Figure 4:
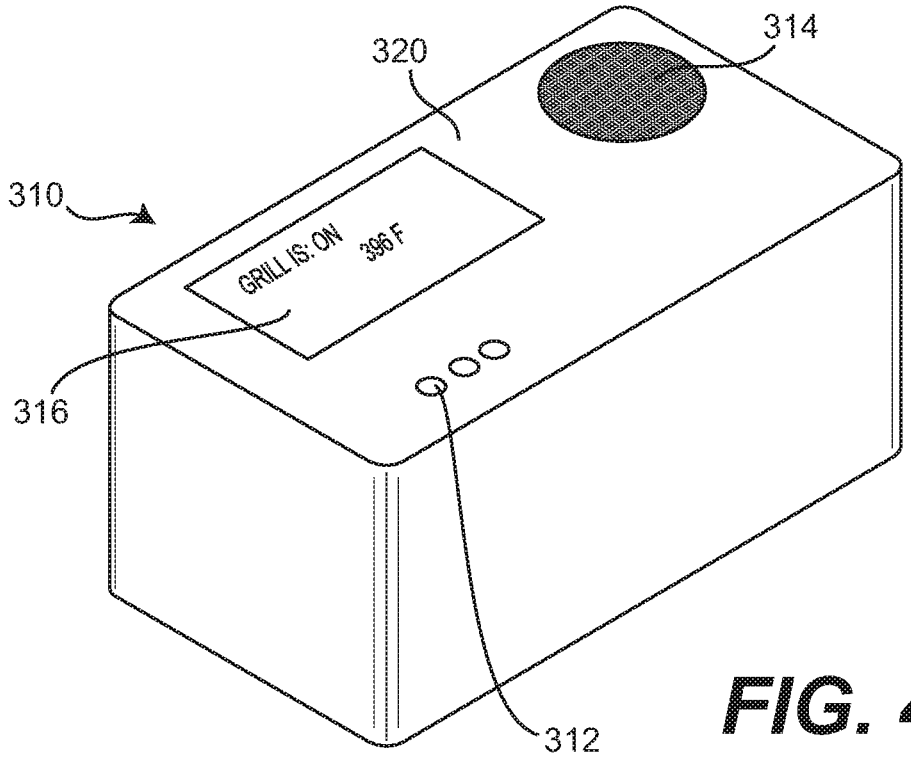
FIG. 4 is a top perspective view of an indicator assembly in accordance with an embodiment of the present disclosure.

FIG. 4 shows a closer view of an embodiment of indicator assembly 310. Indicator assembly 310 may be made up of indicator housing 320, indicator lights 312, alarm 314, and indicator screen 316. In some embodiments, indicator lights 312 can include a "Grill is On" light, a "Safe to Light" light, and an "Unsafe to Light" light. Other lights can also be included to indicate that a cleaning mode or other program is running, or that a mobile device is connected via Wi-Fi or Bluetooth (discussed further below). Indicator screen 316 can include information such as grill assembly temperature, remaining fuel level, remaining grilling time, or the like. In some embodiments, indicator assembly 310 may house other components, such as system controller 200 and power source 212. Indicator assembly 310 may be integrally installed in grill assembly 300, or may be a modular unit. Wires can connect indicator assembly 310 to sensor assembly 302 as well as other components; however wireless communication mechanisms can also be used in appropriate applications.

Because indicator housing 320 does not have to be located inside of grill body 110, it need not necessarily be as heat resistant as sensor assembly 302. However in some embodiments according to the present disclosure, sensor assembly 302 and indicator assembly 310 are combined in a unitary device. This device could be placed on grilling surface 304 during grill operation, and a user may rely on alarm 314 for an unsafe to light warning, as opposed to lights 312 (when grill lid 306 is closed).

Figure 5:
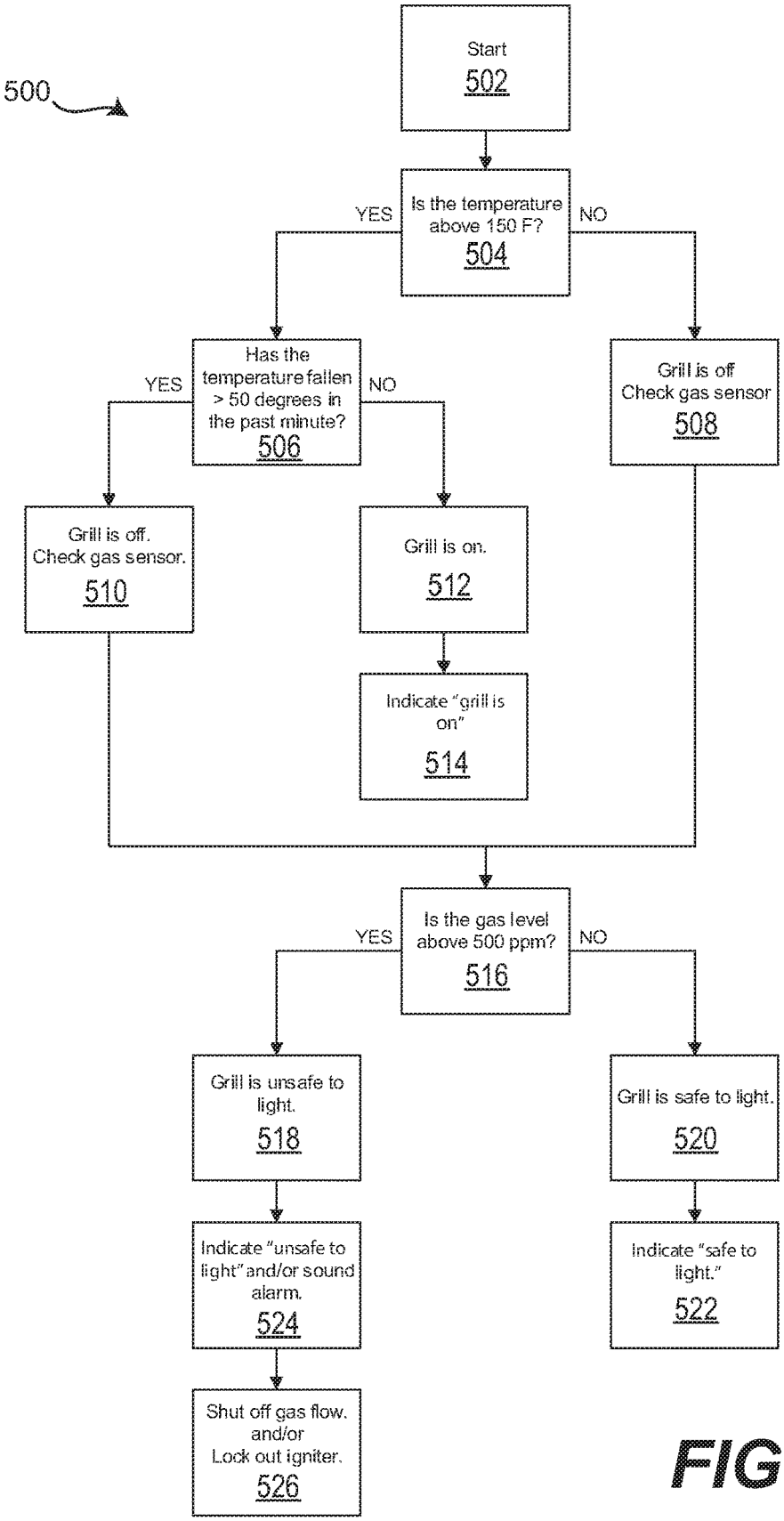
FIG. 5 is a flowchart describing the logic behind certain safety and warning aspects of a system in accordance with the present disclosure.

FIG. 5 illustrates the logic 500 behind system controller 200 as it relates to safety indicators and safety controls. Starting at 502, the first question at 504 is whether or not the temperature is above a particular threshold, for example and not limitation, 150 F. If temperature sensor 204 indicates that this is the case, the next step at 506 is to determine if the temperature has experienced a rapid drop recently, for example and not limitation, a drop of more than 50 degrees in the past minute. If temperature sensor 204 indicates that it is not the case that the temperature is above the temperature threshold (508), this is an indication that the grill is not on, and the system should proceed to checking gas sensor 202. If the temperature has experienced a rapid drop recently (510), this may also indicate that the grill is off, and as before, the system should proceed to checking gas sensor 202. If the temperature is both above the threshold and has not experienced a rapid drop (512), the grill is likely on and lit. In this case system controller 200 may indicate this condition by turning on the appropriate indicator light 312, or by another suitable means.

If the grill is off, gas sensor 202 can be monitored to detect an unsafe condition (516). In the event that gas sensor 202 indicates the presence of gas above a safe concentration, for example and not limitation, 500 parts per million (ppm), the grill may be unsafe to light (518). If gas sensor 202 indicates the presence of gas below the upper safe concentration limit, the grill may be safe to light (520). In the event that the grill is safe, system controller 200 may indicate this condition by turning on the appropriate indicator light 312, or by another suitable means (522). If lighting the grill may be unsafe, system controller 200 may indicate this condition by turning on the appropriate indicator light 312, activating alarm 314, or by another suitable means (524). As an additional or alternative safety measure, system controller 200 can shut off the gas flow by actuating shutoff valve 208 and/or preventing igniter 108 from functioning (526). This may not only warn of an unsafe condition, but also actively take steps to eliminate it.

Figure 6:
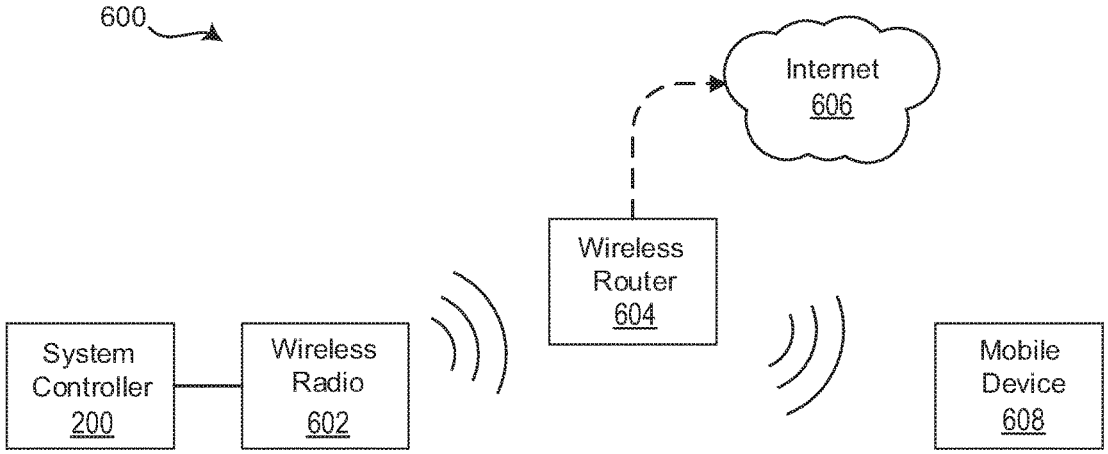
FIG. 6 is a schematic depiction of a Wi-Fi based communication path between a system controller and a mobile device, in accordance with an embodiment of the present disclosure.
Figure 7:
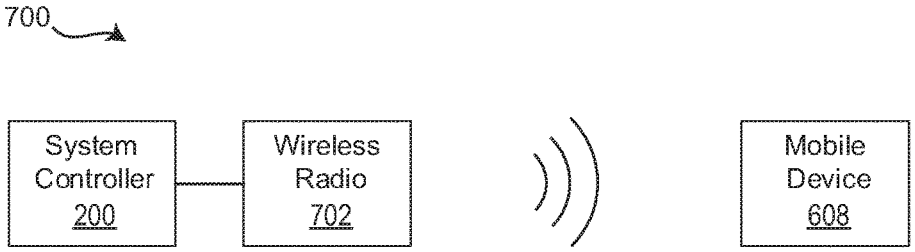
FIG. 7 is a schematic depiction of a Bluetooth based communication path between a system controller and a mobile device, in accordance with an embodiment of the present disclosure.

In some embodiments, grilling system 100 is provided with network connectivity. FIGS. 6 and 7 depict Wi-Fi and Bluetooth communication architectures, respectively. Wi-Fi arrangement 600 shows system controller 200 in communication with a wireless radio 602. Wireless radio 602 may communicate using Wi-Fi (or other suitable protocols) with wireless router or server 604. Wireless router 604 can then communicate as is known in the networking field with the internet 606. A user can then send and receive messages by connecting a mobile device 608 to internet 606, including by accessing wireless router 604 or another suitable internet connection. Arrangement 600 can allow for grill control and monitoring both nearby and remotely, allowing an unsafe condition to alert a grill owner even while away from home. This can be beneficial if a child or other family member is using the grill in an unsafe manner, and allows a user to initiate safety measures and alerts remotely.

The Bluetooth arrangement 700, depicted in FIG. 7 is somewhat simpler. System controller 200 can still be in communication with a wireless radio 602. In this instance, wireless radio 602 may communicate using Bluetooth (or other suitable short-range protocols) directly with a user's mobile device 608. This arrangement has the advantages of not requiring a functional wireless network or internet service; however the range of a Bluetooth connection may be limited to between 10 and 100 feet, depending upon the environment and obstructions. This limited range will often not be an issue, since it may actually be desirable (for safety reasons) to require the grill operator/monitor to be within Bluetooth range. In some embodiments, a Bluetooth connected mobile device may be required to operate certain grill features, such as a cleaning mode, so that the system controller can be assured that a user is nearby.

The basic architecture discussed above with regard to sensors, actuators, and networking provides a number of additional feature options for both safety and convenience. For example, a user may be able to preheat a grill while preparing the food to be cooked. No longer will a griller have to make a trip outside to turn on and light the grill, and then return inside to continue food preparation. This capability can also address the issue of flame loss (or flame blowout). A grill may sometimes have its flame blown out by the wind, causing the temperature to drop and the food to stop cooking. Because the gas keeps flowing, it may lead to an unsafe lighting condition. A system as described may be able to not only alert a user of the flame loss, but also allow a safe remote relighting. Similarly, a user may be able to turn off an unused grill without returning to the grill itself. This can be beneficial when a meal is to be eaten away from the grill, or if the grill is left on in case additional food is requested or desired.

In some embodiments, a mobile application may even allow for the temperature to be varied over time, or in response to a food temperature sensor. This can allow a user to have a great deal of control over the heat at which food is to be started, cooked, and finished/kept warm. Tank weight sensor 206 can allow a user to remotely check to make sure they have enough fuel for their planned grilling without being home. This may prevent repeated trips to the store, or worse, a gathering being interrupted by having to make a trip for additional fuel or ended due to an inability to get additional fuel (such as on a holiday). Increasing the versatility and convenience of the grilling process while also increasing the safety can result in significant improvements to a user's satisfaction with their grill.

The ability to light, adjust the temperature, and/or shut off the grill remotely can also allow for a simpler cleaning cycle. Many grill users prefer to clean their grills by turning the temperature up on the grill with no food inside to burn off any debris. If left alone in this condition, the grill may cause a fire with something that comes into contact with it, or something adjacent to it. The disclosed system can allow for this cleaning cycle to run on a timer, and to be monitored and aborted if necessary, without requiring a user to be within an arm's reach of a hot grill.

The disclosed system can include a number of additional sensors or actuators to provide other safety or convenience features. For example, a tilt sensor may be provided to cut the flow of gas in the event that the grill is knocked or blown over. This may prevent an accidental fire, without requiring a user to be dangerously near a hot, overturned grill. Another sensor that may be provided is a lid sensor for indicating the position of the grill's lid. Such an input may allow for a cleaning cycle to be aborted should the grill be opened during the cycle. Due to the very high heat used for grill cleaning, this may be beneficial. Relatedly, a lid lock may be included such that the grill can be remotely latched or unlatched. This may prevent unauthorized use, the interruption of a cleaning cycle, or other such issues that may arise.

From the foregoing, it can be seen that the invention provides a grilling system that provides features designed to both improve safety and make grilling more convenient. It will be appreciated by those skilled in the art, however, that the invention can be embodied in other specific forms without departing from the spirit or essential characteristics thereof. For example, while the invention has been described in the context of an outdoor grilling system, the concepts described herein need not be limited to this illustrative embodiment. For example, other devices involving open flames such as ovens, turkey fryers, heating devices, and other such appliances would enjoy many of the same benefits as described above. Additionally, the specific configurations, choice of materials, and the size and shape of various elements, including the chosen sensors and actuators, could be varied according to particular design specifications or constraints requiring a grilling system to meet additional of different design parameters. Such changes are intended to be embraced within the scope of the invention.

The presently disclosed embodiments are, therefore, considered in all respects to be illustrative and not restrictive. The scope of the invention is indicated by the appended claims, rather than the foregoing description, and all changes that come within the meaning and range of equivalents thereof are intended to be embraced therein.

What is claimed is:

1. A grilling system comprising:

a grill comprising a grill body, a grill lid, a grilling surface, a burner, a gas feed line, a gas tank, a grill adjustment valve, and an igniter;

a shutoff valve located in the gas feed line;

a sensor assembly comprising:

a gas sensor;

a temperature sensor; and a sensor housing; and a system controller wirelessly communicative with the gas sensor and the temperature sensor and receiving a gas sensor value and a temperature sensor value;

wherein the system controller indicates a condition of the grill responsive to the gas sensor value and the temperature sensor value;

wherein the system controller can receive user commands inputted via a mobile application on a mobile device;

wherein responsive to a delay user command, the system controller delays the actuation of the shutoff valve until after an amount of time from receipt of the delay user command; and wherein responsive to an ignition user command, the system controller activates the igniter.

2. The grilling system of claim 1, wherein the system controller indicates an unsafe condition of the grill when receiving a temperature sensor value of less than about 150 degrees Fahrenheit, and receiving a gas sensor value of greater than about 500 ppm.

3. The grilling system of claim 1, wherein the system controller indicates a safe condition of the grill when receiving one or both a temperature sensor value of greater than about 150 degrees Fahrenheit, and a gas sensor value of less than about 500 ppm.

4. The grilling system of claim 1 further comprising one or more indicator lights;

wherein the system controller indicates the condition of the grill by activating one or more of the indicator lights.

5. The grilling system of claim 1 further comprising an audible alarm;

wherein the system controller indicates the condition of the grill by activating the audible alarm.

6. The grilling system of claim 1, wherein the sensor housing is removably attached to at least one of the grill body, the grill lid, and the grilling surface.

7. The grilling system of claim 6, wherein the sensor housing is magnetic.

8. The grilling system of claim 1, wherein the system controller actuates the shutoff valve in response to the condition of the grill.

9. The grilling system of claim 1, wherein the system controller disables the igniter in response to the condition of the grill.

10. The grilling system of claim 1, wherein the system controller further comprises a wireless radio; and wherein the system controller indicates the condition of the grill by transmitting a signal via the wireless radio to the mobile device.

11. The grilling system of claim 10, wherein the wireless radio is a Bluetooth transceiver; and wherein the signal is sent via the mobile application on the mobile device.

12. The grilling system of claim 10, wherein the wireless radio is a Wi-Fi transceiver; and wherein the signal is sent via the mobile application on the mobile device.

13. The grilling system of claim 1 further comprising an adjustment valve actuator communicative with the system controller;

wherein the adjustment valve actuator actuates the grill adjustment valve responsive to the system controller; and wherein actuating the grill adjustment valve adjusts the temperature of the grill.

14. The grilling system of claim 13, wherein the system controller:

actuates the grill adjustment valve to adjust the temperature of the grill to a cleaning temperature for a predetermined cleaning time; and thereafter actuates the shut off valve.

15. The grilling system of claim 1 further comprising a tank weight sensor positioned underneath the gas tank and configured to output a tank weight signal to the system controller;

wherein the system controller indicates an amount of gas remaining in the gas tank based on the tank weight signal.

16. The grilling system of claim 15, wherein the system controller indicates the amount of gas remaining via the mobile application.

* * * * *